US011095964B2

(12) United States Patent
Kitamura

(10) Patent No.: US 11,095,964 B2
(45) Date of Patent: Aug. 17, 2021

(54) BONE-CONDUCTION EARPHONE MICROPHONE

(71) Applicant: EKO TECHNO INC., Yokohama (JP)

(72) Inventor: Norio Kitamura, Kanagawa (JP)

(73) Assignee: EKO TECHNO INC., Yokohama (JP)

( * ) Notice: Subject to any disclaimer, the term of this patent is extended or adjusted under 35 U.S.C. 154(b) by 0 days.

(21) Appl. No.: 16/986,898

(22) Filed: Aug. 6, 2020

(65) Prior Publication Data

US 2020/0382855 A1 Dec. 3, 2020

Related U.S. Application Data

(63) Continuation of application No. PCT/JP2019/012370, filed on Mar. 25, 2019.

(30) Foreign Application Priority Data

Apr. 13, 2018 (JP) ..... JP2018-077327

(51) Int. Cl.
*H04R 1/10* (2006.01)
*H04R 1/08* (2006.01)

(52) U.S. Cl.
CPC ..... *H04R 1/08* (2013.01); *H04R 1/10* (2013.01)

(58) Field of Classification Search
CPC ..... H04R 1/08; H04R 1/10; H04R 1/1016; H04R 1/1083; H04R 1/1066; H04R 25/10;

(Continued)

(56) References Cited

U.S. PATENT DOCUMENTS 5,692,059 A * 11/1997 Kruger ..... H04R 1/1016 381/151
8,189,845 B2 * 5/2012 Mulvey ..... H04R 1/1016 381/380

(Continued)

FOREIGN PATENT DOCUMENTS

JP 3033994 U 2/1997
JP 2002-125298 A 4/2002

(Continued)

OTHER PUBLICATIONS

International Search Report issued by the Japan Patent Office for corresponding International Patent Application No. PCT/JP2019/012370, dated May 21, 2019, with an English translation.

*Primary Examiner* — Thang V Tran
(74) *Attorney, Agent, or Firm* — Myers Wolin, LLC

(57) ABSTRACT

To provide a bone-conduction earphone microphone provided with adequate noise control measures for workers working in a noisy workplace, thus enabling the workers to perform smooth communication with other people. The bone-conduction earphone microphone has a configuration in which a bone-conduction sound vibration unit 110 and a projection part 11 connected thereto are formed in a main body 1, and a core part 20 of a polyurethane first earplug section 2*a* and the projection part 11 are connected, facing each other, by a tubular connection section 30. This configuration enables the bone-conduction earphone microphone to provide hearing protection by acting as a high sound-insulation earplug for an ear canal, and also to perform input and output of voices by means of bone-conduction sound vibrations without picking up noises.

12 Claims, 5 Drawing Sheets

(58) Field of Classification Search
CPC .... H04R 25/60; H04R 25/602; H04R 25/604; H04R 2225/61; H04R 2420/07; H04R 2460/13; H04R 3/00; G61F 11/06; G61F 11/08; G61F 11/16; G61F 2011/085
See application file for complete search history.

(56) References Cited

U.S. PATENT DOCUMENTS

| | | | | |
|---|---|---|---|---|
| 8,774,435 | B2 * | 7/2014 | Ambrose | H04R 1/1016 381/328 |
| 10,860,114 | B1 * | 12/2020 | Oommen | H04R 1/1041 |
| 2008/0152163 | A1 | 6/2008 | Mulvey | |
| 2010/0061580 | A1 * | 3/2010 | Tiscareno | H04R 1/1016 381/380 |
| 2011/0103605 | A1 * | 5/2011 | Killion | H04R 1/1083 381/72 |
| 2017/0188133 | A1 * | 6/2017 | Olson | H04R 1/1066 |
| 2018/0146280 | A1 * | 5/2018 | Tang | H04R 9/06 |

FOREIGN PATENT DOCUMENTS

| | | | | | |
|---|---|---|---|---|---|
| JP | 2007-281711 | A | | 10/2007 | |
| JP | 2008-160847 | A | | 7/2008 | |
| JP | 2013-038455 | A | | 2/2013 | |
| JP | 5625928 | B | | 11/2014 | |
| JP | 6054317 | B | | 12/2016 | |
| JP | 2017147677 | A | * | 8/2017 | H04R 1/10 |
| KR | 101678613 | B1 | * | 11/2016 | H04R 1/10 |
| WO | WO-2010005039 | A1 | * | 1/2010 | H04R 1/1016 |
| WO | 2018/051453 | A1 | | 3/2018 | |
| WO | WO-2018051453 | A1 | * | 3/2018 | H04R 1/06 |

* cited by examiner

BONE-CONDUCTION EARPHONE MICROPHONE

CROSS-REFERENCE TO RELATED APPLICATION

This application is a continuation application of International Application PCT/JP2019/012370, filed on Mar. 25, 2019 and designated the U.S., which claims priority to Japanese Patent Application No. 2018-077327, filed on Apr. 13, 2018. The contents of these applications are incorporated herein by reference.

TECHNICAL FIELD

The present invention relates to a bone-conduction earphone microphone and more particularly to a bone-conduction earphone microphone which significantly cuts noises at a noisy construction site or the like so as to make it possible to hear the voices on a call using a wireless device, and which is capable of transmitting, with reduced noise, the voices to be transmitted.

BACKGROUND

Related Art

Hitherto, bone-conduction earphone microphones have been known.

A bone-conduction earphone microphone includes a vibration detection element that detects a bone-conduction sound vibration propagating to the vicinity of an ear, a microphone unit that includes an amplifying device (amplifier) that amplifies the output, and an earphone unit that includes a conversion unit that converts an audio signal input from an external source into a bone-conduction sound vibration.

As related arts, there are Japanese Patent Laid-Open Publication No. 2002-125298 "Microphone device and earphone microphone device" (Patent Literature 1), Japanese Patent Laid-Open Publication No. 2013-038455 "Noise suppression earphone microphone" (Patent Literature 2), U.S. Pat. No. 5,625,928 publication "Earphone for TV program performer" (Patent Literature 3), U.S. Pat. No. 6,054,317 "Bone-conduction earphone" (Patent Literature 4), and Utility Model Registration No. 3033994 "Bone-conduction microphone device" (Patent Literature 5).

Patent Literature 1 describes an earphone microphone provided with a bone-conduction microphone.

Patent Literature 2 describes an earphone microphone which is used in a noisy environment and which has a bone-conduction speaker and a microphone that does not transmit the vibrations thereof.

Patent Literature 3 describes a bone-conduction earphone for a TV program performer, which is configured to make it easy to hear even in the presence of noise.

Patent Literature 4 describes a bone-conduction earphone provided with a bone-conduction microphone and a bone-conduction speaker.

Patent Literature 5 describes a bone-conduction microphone device provided with a regular speaker and a bone-conduction microphone.

RELATED ART LITERATURE

Patent Literatures

[Patent Literature 1] Japanese Patent Laid-Open Publication No. 2002-125298

[Patent Literature 2] Japanese Patent Laid-Open Publication No. 2013-038455

[Patent Literature 3] U.S. Pat. No. 5,625,928

[Patent Literature 4] U.S. Pat. No. 6,054,317

[Patent Literature 5] Utility Model Registration No. 3033994

However, the conventional bone-conduction earphone microphones, which use bone-conduction sound vibrations, have been posing a problem in that they have a low Noise Reduction Rating (NRR), so that they are configured with insufficient considerations given to use in workplace environments with high noise levels (noisy workplaces).

Specifically, in a noisy workplace, it is desirable to use earplugs with high sound insulation to protect hearing when workers do not talk with other people. However, the conventional bone-conduction earphone microphones are not earplugs and therefore do not provide adequate noise control measures for workers who wear them.

Further, using the conventional bone-conduction earphone microphones as earphones is not practical, because the bone-conduction earphone microphones pick up ambient noises, making it difficult to hear.

In addition, when the conventional bone-conduction earphone microphones are used as microphones, the noises contained in voices make it difficult for a communication partner to hear the voices.

Patent Literatures 1 to 5 include ones that take noise into account, but are not configured to be devices that provide adequate noise control measures best suited for communication in a workplace environment with a constantly high noise level.

SUMMARY OF THE INVENTION

The present invention has been made in view of the actual circumstances described above, and an object of the invention is to provide a bone-conduction earphone microphone that provides sufficient noise control measures for a worker working at a noisy workplace, thereby enabling the worker to perform smooth communication with other people.

The present invention for solving the problems with the conventional examples described above is a bone-conduction earphone microphone, including a main body having a bone-conduction sound vibration unit which generates a bone-conduction sound vibration, and a projection part connected to the bone-conduction sound vibration unit; a polyurethane earplug section having a core part; and a connection section which is shaped like a tube with both ends thereof open, the projection part being inserted in one open portion of the tube and the core part being inserted in the other open portion of the tube thereby to connect the projection part and the core part, wherein the core part of the earplug section has a columnar shape, the projection part of the main body is cylindrical and hollow inside, the core part of the earplug section being inserted in the hollow, and the connection section has an inner diameter that is smaller than the diameter of the core part and the diameter of the projection part. The bone-conduction earphone microphone acts as an earplug with high sound insulation for an ear canal to make it possible to protect hearing, and also permits input and output of voices by bone-conduction sound vibrations without picking up noises, thus providing an effect that enables easy hearing and transmitting of sound with reduced noise thereby to achieve smooth call communication even in a noisy environment.

According to the present invention, in the bone-conduction earphone microphone, the shape of the earplug section is conical or columnar, or spherical or hemispherical.

According to the present invention, in the bone-conduction earphone microphone, the earplug section conforms to the standard of JIS T8161EP-1 or the standard of ANSI S3 19-1974.

According to the present invention, in the bone-conduction earphone microphone, the bone-conduction sound vibration unit works as a bone-conduction earphone that converts an audio signal into a bone-conduction sound vibration and also works as a bone-conduction microphone that converts a bone-conduction sound vibration into an audio signal.

The bone-conduction earphone microphone according to the present invention includes: an amplifier that amplifies an audio signal from the bone-conduction sound vibration unit; and a PTT switch that controls turning ON/OFF of the amplifier and also controls a transmission mode and a reception mode of a wireless device, wherein in the case where the PTT switch is turned on, the amplifier is turned on and a control signal for setting the wireless device to a transmission mode is output to cause the bone-conduction sound vibration unit to work as a bone-conduction microphone, and in the case where the PTT switch is turned off, the amplifier is turned off and a control signal for setting the wireless device to a reception mode is output to cause the bone-conduction sound vibration unit to work as a bone-conduction earphone.

DESCRIPTION OF REFERENCE NUMERALS

1 . . . main body; 2*a* . . . first earplug section; 2*b* . . . second earplug section; 2*c* . . . third earplug section; 10 . . . main body case; 11, 11*a* . . . projection part; 12 . . . cable; 20, 20*a*, 20*b* core part; 21, 22 . . . ear canal fitting section; 30 . . . connection section; 31 . . . hollow portion; 110 . . . bone-conduction sound vibration unit; 120 . . . amplifier (AMP); 130 . . . PTT switch (PTT SW); 140 . . . audio input terminal; 150 . . . audio output terminal; and 160 . . . transmission control signal terminal.

DESCRIPTION OF THE PREFERRED EMBODIMENT

An embodiment of the present invention will be described with reference to the accompanying drawings.

[Summary of Embodiment]

In a bone-conduction earphone microphone according to an embodiment of the present invention (the earphone microphone), a bone-conduction sound vibration unit and a projection part connected thereto are formed in a main body, and a core part of a polyurethane earplug section and the projection part, which face each other, are connected by a tubular connection section. Hence, the earphone microphone can protect hearing by acting as an earplug with high sound insulation for an ear canal and can also input and output voices by bone-conduction sound vibrations without picking up noises. This makes it possible to easily hear and to transmit, with reduced noise, voices to be transmitted, thus providing the effect of enabling smooth call communication to be achieved even in a noisy environment.

In addition, the earphone microphone is adapted such that the single bone-conduction sound vibration unit can be used as a bone-conduction earphone and a bone-conduction microphone in alternate call communication by switching a selector switch, namely, a PTT switch, thus enabling the device configuration to be simplified and reduced in size.

In the earphone microphone, a description will be given of two different shapes of the polyurethane part of the earplug section, namely, a conical shape (a first bone-conduction earphone microphone) and a spherical shape (a second bone-conduction earphone microphone); however, the shape is not limited to the two types of shape, and may alternatively be a columnar shape or a two-tiered conical shape.

Figure 1:
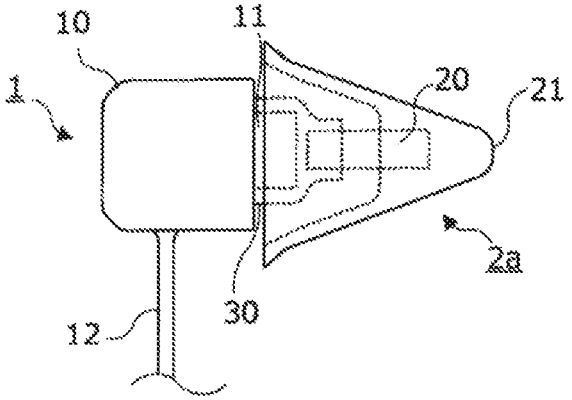
FIG. 1 is a schematic diagram of a first bone-conduction earphone microphone.

[First Earphone Microphone: FIG. 1]

Referring to FIG. 1, a first bone-conduction earphone microphone (a first earphone microphone) in the earphone microphone will be described. FIG. 1 is a schematic diagram of the first bone-conduction earphone microphone.

As illustrated in FIG. 1, the first earphone microphone basically has a main body 1, a first earplug section 2*a*, and a connection section 30 that connects the main body 1 and the first earplug section 2*a*.

[Components of the First Earphone Microphone]

Figure 2:
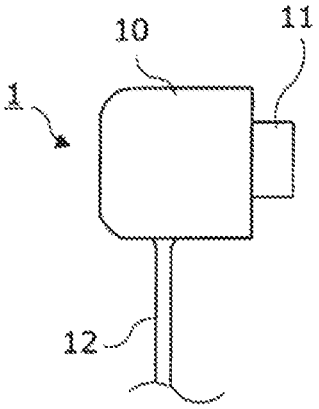
FIG. 2 is a schematic diagram illustrating a main body.
Figure 3:
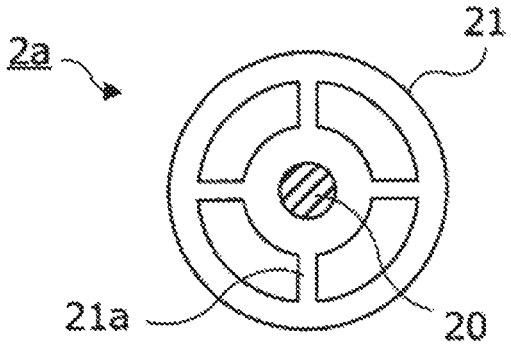
FIG. 3 is a schematic diagram illustrating the inside of a first earplug section.
Figure 4:
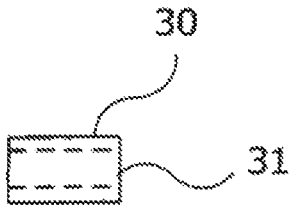
FIG. 4 is a schematic diagram of a connection section.

Referring now to FIG. 1 to FIG. 4, each component of the first earphone microphone will be specifically described. FIG. 2 is a schematic diagram illustrating a main body, FIG. 3 is a schematic diagram illustrating the inside of a first earplug section, and FIG. 4 is a schematic diagram of the connection section.

[Main Body: FIG. 1 and FIG. 2]

As illustrated in FIG. 1 and FIG. 2, the main body 1 includes a main body case 10, a projection part 11, and a cable 12.

The main body case 10 is provided with a circuit, which will be discussed later, therein, and incorporates, in particular, a bone-conduction sound vibration unit.

The bone-conduction sound vibration unit works as a bone-conduction earphone that converts audio signals into bone-conduction sound vibrations, and also works as a bone-conduction microphone that converts bone-conduction sound vibrations into audio signals.

The projection part 11 projects outward from the main body case 10 and connects to the bone-conduction sound vibration unit. The projection part 11 has a columnar shape.

The cable 12 has one end thereof connected to the bone-conduction sound vibration unit in the main body case 10 and the other end thereof connected to a relay board (a board on which an amplifier and a PTT switch are mounted) for connection to a wireless communication device (a wireless device), although not illustrated.

The cable 12 is a wiring cable for input and output of audio signals.

[First Earplug Section 2*a*: FIG. 1 and FIG. 3]

As illustrated in FIG. 1 and FIG. 3, the first earplug section 2*a* includes a core part 20 and an ear canal fitting section 21.

The core part 20 provides the core of the ear canal fitting section 21, is formed of a plastic column, and is fitted and glued to the ear canal fitting section 21 to prevent falling off.

The ear canal fitting section 21 is formed of polyurethane and has a conical shape or a columnar shape, the core part 20 being inserted in and fixed to the inner center thereof. The end of the core part 20 that is not inserted in the ear canal fitting section 21 is exposed, not being covered by the polyurethane.

The ear canal fitting section 21 may be made of a material other than polyurethane insofar as the material satisfies the standards given below.

The first earplug section 2*a* conforms, as an earplug, to either the standard of JIS T8161 EP-1 or the standard of ANSIS3 19-1974, or both of these standards.

The conformance to these standards enables the first earplug section 2*a* to provide high sound insulation, thus making it easy to hear while protecting hearing at the same time.

As illustrated in FIG. 3, the ear canal fitting section 21 has reinforcing parts 21*a* formed to project inward from the inner wall to retain the external conical shape.

In the example of FIG. 3, the drawing illustrates a view from the side connected to the connection section 30 of the ear canal fitting section 21 toward the inner back of the ear canal fitting section 21.

[Connection Section 30: FIG. 4]

The connection section 30 is formed of silicone rubber, natural rubber, synthetic rubber, urethane rubber, or the like, and shaped like a tube with a hollow portion 31, which is a hollow space. The hollow portion 31 provides an open portion at an end of the connection section 30.

The connection section 30 has a length of about 7 to 10 mm, an outer diameter of about 7 mm, and an inner diameter of about 5 mm.

The inner diameter of the connection section 30, in particular, is set to be smaller than the outer diameter of the projection part 11 of the main body 1 and also smaller than the outer diameter of the core part 20 of the first earplug section 2*a*.

Further, the projection part 11 is inserted from one tubular end portion of the connection section 30 and the core part 20 is inserted from the other end portion thereof and fixed so as to connect the projection part 11 and the core part 20.

Since the inner diameter of the connection section 30 is smaller than the inner diameters of the projection part 11 and the core part 20, the hollow portion 31 has to be spread to insert these parts. The elastic force of the rubber firmly secures and connects the projection part 11 and the core part 20.

The connection section 30 has a tubular shape with uniform outer diameter and inner diameter as a whole. Alternatively, however, the connection section 30 may have a stepped tubular shape. For example, the outer diameter and the inner diameter of the end portion on the projection part 11 side may be set to be larger than the outer diameter and the inner diameter of the end portion on the core part 20 side, so that the connection section 30 looks as if it were formed by connecting two different tubes.

Figure 5:
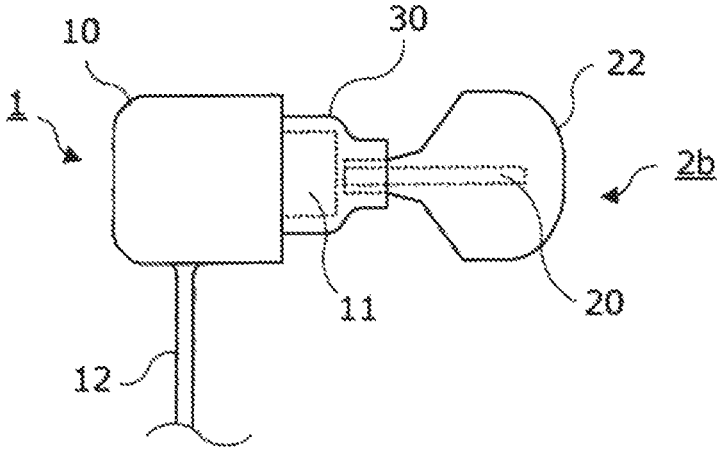
FIG. 5 is a schematic diagram of a second bone-conduction earphone microphone.
Figure 6:
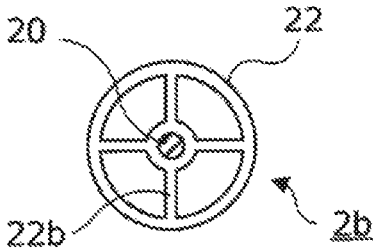
FIG. 6 is a schematic diagram illustrating the inside of a second earplug section.

[Second Earphone Microphone: FIG. 5 and FIG. 6]

Referring now to FIG. 5 and FIG. 6, a description will be given of a second bone-conduction earphone microphone (a second earphone microphone) in the earphone microphone. FIG. 5 is a schematic diagram of the second bone-conduction earphone microphone, and FIG. 6 is a schematic diagram of the inside of a second earplug section.

As illustrated in FIG. 5, the second earphone microphone includes a main body 1, a second earplug section 2*b*, and a connection section 30.

The main body 1 and the connection section 30 are the same as those of the first earphone microphone.

The second earplug section 2*b* has a shape that characterizes the second earphone microphone.

[Second Earplug Section 2*b*: FIG. 5 and FIG. 6]

The second earplug section 2*b* will be described in detail.

As illustrated in FIG. 5 and FIG. 6, the second earplug section 2*b* has a core part 20 and an ear canal fitting section 22.

The core part 20 is formed of a plastic column, and is fitted and glued to an ear canal fitting section 22 to prevent falling off.

The ear canal fitting section 22 is made of polyurethane, shaped like a sphere or hemisphere, and formed such that one end portion of the core part 20 is inserted in and fixed to the inner center and the other end portion of the core part 20 is covered. In other words, the core part 20 projecting from the ear canal fitting section 22 is covered by a polyurethane film.

The ear canal fitting section 22 may be made of a material other than polyurethane insofar as the material satisfies the standards to be discussed later.

Further, the core part 20 is shorter than that of the first earplug section 2*a*, so that the core part 20 is less likely to fall off the ear canal fitting section 22.

In addition, the diameter of the core part 20 of the second earphone microphone is smaller than that of the core part of the first earphone microphone, so that the core part 20 is covered by the polyurethane film to increase the diameter of the end portion to be inserted into the connection section 30 thereby to increase the strength of fitting to the connection section 30.

The second earplug section 2*b* conforms, as an earplug, to the standard of JIS T8161 EP-1 or the standard of ANSIS3 19-1974, or both of these standards.

The conformance to these standards enables the second earplug section 2*b* to provide high sound insulation, thus making it easy to hear while protecting hearing at the same time.

The ear canal fitting section 21 in the first earphone microphone has a larger area of contact with an ear canal, thus providing higher sound insulation. However, the ear canal fitting section 22 of the second earphone microphone is smaller and permits easier fitting.

Further, the ear canal fitting section 22 has reinforcing parts 22*b* formed, extending outward from the circumference of the core part 20 to retain the spherical or hemispherical shape, as illustrated in FIG. 6.

In addition, a projection part 11 of the main body 1 is inserted from one end portion of the connection section 30, and the core part 20 covered by the polyurethane film of the second earplug section 2*b* is inserted from the other end portion of the connection section 30 thereby to connect and fix the both parts.

Figure 8:
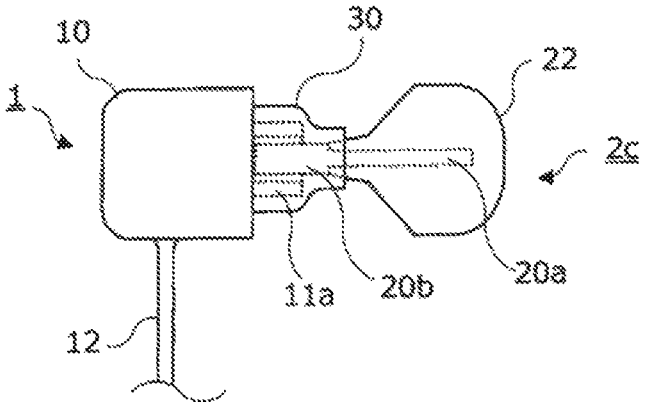
FIG. 8 is a schematic diagram of a third bone-conduction earphone microphone.
Figure 9:
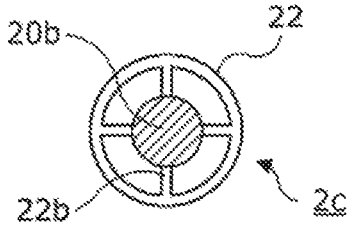
FIG. 9 is a schematic diagram illustrating the inside of a third earplug section.

[Third Earphone Microphone: FIG. 8 and FIG. 9]

Referring now to FIG. 8 and FIG. 9, a description will be given of a third bone-conduction earphone microphone (a third earphone microphone) in the earphone microphone. FIG. 8 is a schematic diagram of the third bone-conduction earphone microphone, and FIG. 9 is a schematic diagram of the inside of a third earplug section.

As illustrated in FIG. 8, the third earphone microphone includes a main body 1, a third earplug section 2*c*, and a connection section 30.

The connection section 30 is the same as those of the first and the second earphone microphones.

The third earplug section 2*c* has the same shape as that of the second earphone microphone except that the shape thereof on the connection section 30 side is different from that of the second earphone microphone.

In the first and the second earphone microphones, the main body 1 has the columnar projection part 11 projecting toward the first and the second earplug sections 2*a* and 2*b*, respectively. In the third earphone microphone, a projection part 11*a* is cylindrical, and hollow inside, thus making it possible to insert therein a core part 20*b* of the earplug section 2*c*, which will be discussed later.

In order to make it easy to insert the core part 20*b* into the projection part 11*a*, a slit may be formed in an axial direction (a lateral direction in FIG. 8) from the opening of the projection part 11*a*.

[Third Earplug Section 2*c*: FIG. 8 and FIG. 9]

The third earplug section 2*c* will be described in detail.

The third earplug section 2*c* has core parts 20*a* and 20*b*, and an ear canal fitting section 22, as illustrated in FIG. 8 and FIG. 9.

The core parts 20*a* and 20*b* are made of plastic and are integrally formed in columnar shapes having different diameters.

The core part 20*a* is columnar, and fitted and glued to the ear canal fitting section 22 to prevent falling off.

The core part 20*b*, which is columnar, has a diameter that is larger than that of the core part 20*a*, and is exposed from the ear canal fitting section 22. The exposed core part 20*b* is inserted in the internal hole (the hollow portion) of the projection part 11*a*.

The central axes of the columns of the core parts 20*a* and 20*b* coincide.

The ear canal fitting section 22 is made of polyurethane, shaped like a sphere or hemisphere, and formed such that one end portion of the core part 20*a* is inserted in and fixed to the inner center thereof, and covered up to the other end portion of the core part 20*a*. Further, the core part 20*b* projects from the ear canal fitting section 22. In other words, the core part 20*b* is not covered by a polyurethane film.

The material of the ear canal fitting section 22 is the same as that of the second earplug section 2*b*.

The core parts 20*a* and 20*b* are integrally structured. The core part 20*b* is inserted into the hollow portion of the projection part 11*a* of the main body 1, and then the projection part 11*a*, which has the core part 20*b* inserted therein, and the core part 20*b* are fixed by the connection section 30. The connection section 30 also fixes a part of the core part 20*a* covered by polyurethane that continues to the core part 20*b*.

Thus, the third earphone microphone has the structure in which the third earplug section 2*c* is less likely to come off the main body 1, as compared with the second earphone microphone.

The third earplug section 2*c* having a structure in which the core part 20*a* is covered with polyurethane can provide high sound insulation, thus making it easy to hear while protecting hearing at the same time.

The ear canal fitting section 21 in the first earphone microphone has a larger area of contact with an ear canal, thus providing higher sound insulation. However, the ear canal fitting section 22 of the third earphone microphone is smaller and permits easier fitting.

Further, in the ear canal fitting section 22, reinforcing parts 22*b* are formed, extending outward from the circumference of the core part 20*b* to retain the spherical or hemispherical shape, as illustrated in FIG. 9.

Further, one end portion of the connection section 30 is inserted to an end portion of the core part 20*b* and further inserted up to a part of the core part 20*a* covered by polyurethane, while the other end portion of the connection section 30 is inserted so as to cover the outer circumference of the projection part 11*a* of the main body 1, and the core part 20*b* is inserted in the hollow portion of the projection part 11*a*, thus connecting and fixing the projection part 11*a* and the third earplug section 2*c*.

Figure 7:
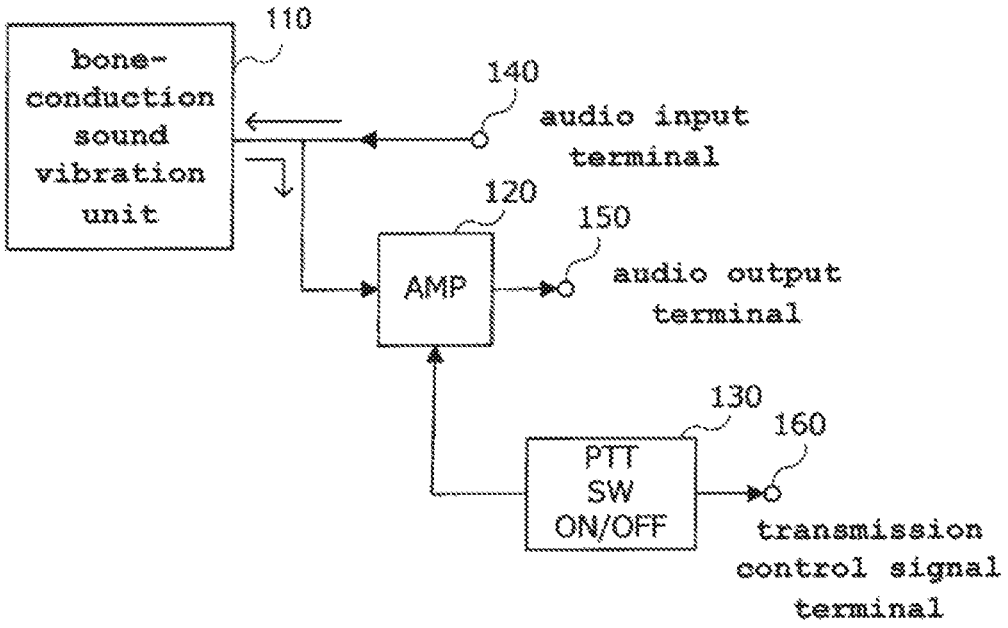
FIG. 7 is a schematic circuit diagram of the earphone microphone with a PTT switch.

[Circuit: FIG. 7]

Referring now to FIG. 7, a circuit configuration of the earphone microphone will be described. FIG. 7 is a schematic circuit diagram of the earphone microphone with a PTT switch.

As illustrated in FIG. 7, the earphone microphone includes a bone-conduction sound vibration unit 110, an amplifier (AMP) 120, a PTT (Press to Talk) switch (PTT SW) 130, an audio input terminal 140, an audio output terminal 150, and a transmission control signal terminal 160.

The bone-conduction sound vibration unit 110 converts an audio signal input from the audio input terminal 140 into a bone-conduction sound vibration and transmits the obtained bone-conduction sound vibration to an ear canal. Then, bone-conduction sound vibration unit 110 detects the bone-conduction sound vibration transmitted from the ear canal, converts the detected bone-conduction sound vibration into an audio signal, and outputs the obtained audio signal to the amplifier 120.

The bone-conduction sound vibration unit 110 works as a bone-conduction earphone when a bone-conduction sound vibration is transmitted (output) to an ear canal, and also works as a bone-conduction microphone when a bone-conduction sound vibration is input from the ear canal.

If the bone-conduction sound vibration unit 110 is replaced by a magnetic earphone, then the magnetic earphone works as a regular earphone and also works as an air vibration microphone.

The amplifier (AMP) 120 is actuated when the PTT switch 130 is turned ON, and amplifies an audio signal from the bone-conduction sound vibration unit 110 and outputs the amplified audio signal to the audio output terminal 150.

When the PTT switch 130 is turned ON, an ON transmission control signal for setting the wireless device to the transmission mode is output to the transmission control signal terminal 160 to cause the wireless device to perform transmission.

When the PTT switch 130 is turned OFF, an OFF transmission control signal for setting the wireless device to the reception mode, preventing the wireless device from performing transmission, is output to the transmission control signal terminal 160.

When the PTT switch 130 is OFF, the amplifier 120 does not operate, and an audio signal will be output from the audio input terminal 140 to the bone-conduction sound vibration unit 110.

In other words, when the PTT switch 130 is turned ON, an audio signal from the bone-conduction sound vibration unit 110 is amplified by the amplifier 120 and output to the audio output terminal 150. When the PTT switch 130 is turned OFF, an audio signal from the audio input terminal 140 is output to the bone-conduction sound vibration unit 110.

The audio input terminal 140 is connected to a wireless device, such as a transceiver, to receive an audio signal input from the wireless device.

The audio output terminal 150 is connected to the wireless device to output an audio signal to the wireless device.

Accordingly, in alternate call communication, one bone-conduction sound vibration unit 110 is used, and when the PTT switch 130 is OFF, the bone-conduction sound vibration unit 110 works as a bone-conduction earphone, which converts an audio signal input from the wireless device to a bone-conduction sound vibration. When the PTT switch 130 is ON, the bone-conduction sound vibration unit 110 works as a bone-conduction microphone, which actuates the amplifier 120 to amplify an audio signal converted from a bone-conduction sound vibration and then outputs the amplified audio signal to the wireless device.

Further, in the example described above, the description has been given of the usage for the alternate call communication. However, for use in simultaneous call communication, two of the earphone microphones are used so that one can be connected to the amplifier 120 and used as a microphone and the other can be connected to the audio input terminal 140 and used as an earphone.

The PTT switch 130 outputs the transmission control signals for turning ON/OFF a transmitter in the same manner as described above.

[Method of Use]

A description will now be given of how to use the earphone microphone.

The three examples of the earphone microphone have been shown. The first earplug section 2*a*, the second earplug section 2*b*, and the third earplug section 2*c* are connected to the main body 1 by the connection section 30, and can be therefore replaced. Depending on a noise environment, the first earplug section 2*a* may be connected and used, the second earplug section 2*b* may be connected and used, or the third earplug section 2*c* may be connected and used.

Further, according to usage situations, the first earplug section 2*a*, the second earplug section 2*b*, and the third earplug section 2*c* can be replaced, if soiled or damaged, with spare earplug sections.

Further, an ear not fitted with the earphone microphone is to be fitted with an earplug that satisfies the foregoing standards.

[Effects of the Embodiment]

According to the earphone microphone, the bone-conduction sound vibration unit 110 and the projection part 11 connected thereto are formed in the main body 1, and the core part 20 of the polyurethane first earplug section 2*a* and the projection part 11, which face each other, are connected by the tubular connection section 30. Thus, the earphone microphone acts as an earplug with high sound insulation for an ear canal to make it possible to protect hearing, and to also make it possible to input and output voices by bone-conduction sound vibrations without picking up noises. This makes it possible to easily hear and to transmit, with reduced noise, voices to be transmitted, thus providing the effect of enabling smooth call communication to be achieved even in a noisy environment.

The present invention is ideally applied to a bone-conduction earphone microphone provided with adequate noise control measures for workers working in noisy workplaces, thus enabling smooth communication with other people.

What is claimed is:

1. A bone-conduction earphone microphone comprising:

a main body having a bone-conduction sound vibration unit that generates a bone-conduction sound vibration, and a projection part connected to the bone-conduction sound vibration unit;

a polyurethane earplug section having a core part; and a connection section which is shaped like a tube with both ends thereof open, the projection part being inserted in one open portion of the tube and the core part being inserted in the other open portion of the tube thereby to connect the projection part and the core part, wherein the core part of the earplug section has a columnar shape, the projection part of the main body is cylindrical and hollow inside, the core part of the earplug section being inserted in the hollow, and the connection section has an inner diameter that is smaller than the diameter of the core part and the diameter of the projection part.

2. The bone-conduction earphone microphone according to claim 1, wherein the shape of the earplug section is conical or columnar, or spherical or hemispherical.

3. The bone-conduction earphone microphone according to claim 1, wherein the earplug section conforms to the standard of JIS T8161 EP-1 or the standard of ANSI S3 19-1974.

4. The bone-conduction earphone microphone according to claim 2, wherein the earplug section conforms to the standard of JIS T8161 EP-1 or the standard of ANSI S3 19-1974.

5. The bone-conduction earphone microphone according to claim 1, wherein the bone-conduction sound vibration unit works as a bone-conduction earphone that converts an audio signal into a bone-conduction sound vibration and also works as a bone-conduction microphone that converts a bone-conduction sound vibration into an audio signal.

6. The bone-conduction earphone microphone according to claim 2, wherein the bone-conduction sound vibration unit works as a bone-conduction earphone that converts an audio signal into a bone-conduction sound vibration and also works as a bone-conduction microphone that converts a bone-conduction sound vibration into an audio signal.

7. The bone-conduction earphone microphone according to claim 3, wherein the bone-conduction sound vibration unit works as a bone-conduction earphone that converts an audio signal into a bone-conduction sound vibration and also works as a bone-conduction microphone that converts a bone-conduction sound vibration into an audio signal.

8. The bone-conduction earphone microphone according to claim 4, wherein the bone-conduction sound vibration unit works as a bone-conduction earphone that converts an audio signal into a bone-conduction sound vibration and also works as a bone-conduction microphone that converts a bone-conduction sound vibration into an audio signal.

9. The bone-conduction earphone microphone according to claim 5, including:

an amplifier that amplifies an audio signal from the bone-conduction sound vibration unit; and a press to talk (PTT) switch that controls turning ON/OFF of the amplifier and also controls a transmission mode and a reception mode of a wireless device, wherein in the case where the PTT switch is turned on, the amplifier is turned on and a control signal for setting the wireless device to a transmission mode is output to cause the bone-conduction sound vibration unit to work as a bone-conduction microphone, and in the case where the PTT switch is turned off, the amplifier is turned off and a control signal for setting the wireless device to a reception mode is output to cause the bone-conduction sound vibration unit to work as a bone-conduction earphone.

10. The bone-conduction earphone microphone according to claim 6, including:

an amplifier that amplifies an audio signal from the bone-conduction sound vibration unit; and a press to talk (PTT) switch that controls turning ON/OFF of the amplifier and also controls a transmission mode and a reception mode of a wireless device, wherein in the case where the PTT switch is turned on, the amplifier is turned on and a control signal for setting the wireless device to a transmission mode is output to cause the bone-conduction sound vibration unit to work as a bone-conduction microphone, and in the case where the PTT switch is turned off, the amplifier is turned off and a control signal for setting the wireless device to a reception mode is output to cause the bone-conduction sound vibration unit to work as a bone-conduction earphone.

11. The bone-conduction earphone microphone according to claim 7, including:

an amplifier that amplifies an audio signal from the bone-conduction sound vibration unit; and a press to talk (PTT) switch that controls turning ON/OFF of the amplifier and also controls a transmission mode and a reception mode of a wireless device, wherein in the case where the PTT switch is turned on, the amplifier is turned on and a control signal for setting the wireless device to a transmission mode is output to cause the bone-conduction sound vibration unit to work as a bone-conduction microphone, and in the case where the PTT switch is turned off, the amplifier is turned off and a control signal for setting the wireless device to a reception mode is output to cause the bone-conduction sound vibration unit to work as a bone-conduction earphone.

12. The bone-conduction earphone microphone according to claim 8, including:

an amplifier that amplifies an audio signal from the bone-conduction sound vibration unit; and a press to talk (PTT) switch that controls turning ON/OFF of the amplifier and also controls a transmission mode and a reception mode of a wireless device, wherein in the case where the PTT switch is turned on, the amplifier is turned on and a control signal for setting the wireless device to a transmission mode is output to cause the bone-conduction sound vibration unit to work as a bone-conduction microphone, and in the case where the PTT switch is turned off, the amplifier is turned off and a control signal for setting the wireless device to a reception mode is output to cause the bone-conduction sound vibration unit to work as a bone-conduction earphone.

* * * * *